US008166577B2

(12) United States Patent
Lee

(10) Patent No.: US 8,166,577 B2
(45) Date of Patent: May 1, 2012

(54) HELMET HAVING ROTATABLE SHIELD

(75) Inventor: Chang-Seob Lee, Gyeonggi-do (KR)

(73) Assignee: HJC Co., Ltd., Gyeonggi-Do (KR)

( * ) Notice: Subject to any disclaimer, the term of this patent is extended or adjusted under 35 U.S.C. 154(b) by 193 days.

(21) Appl. No.: 12/611,995

(22) Filed: Nov. 4, 2009

(65) Prior Publication Data

US 2011/0056002 A1 Mar. 10, 2011

(30) Foreign Application Priority Data

Sep. 8, 2009 (KR) ..... 10-2009-0084531

(51) Int. Cl.
*A42B 1/08* (2006.01)

(52) U.S. Cl. ..... 2/424; 2/6.2; 2/6.3; 2/6.5; 2/6.7; 2/15; 2/422; 2/9

(58) Field of Classification Search ..... 2/6.2, 6.3, 2/6.5, 6.7, 422, 424, 15, 451, 453, 410, 6.4, 2/429, 441, 443, 450, 9, 425; 403/321, 322.1, 403/322.2; 24/458, 453, 297, 663
See application file for complete search history.

(56) References Cited

U.S. PATENT DOCUMENTS 3,123,389 A * 3/1964 Biesecker ..... 292/218
3,310,811 A * 3/1967 Iacono, Jr. ..... 2/6.5
3,945,043 A * 3/1976 DeAngelis ..... 2/8.1
4,100,619 A * 7/1978 Piech et al. ..... 2/10
4,305,160 A * 12/1981 Sundahl ..... 2/424
5,095,551 A * 3/1992 Chin ..... 2/424
5,161,261 A * 11/1992 Kamata ..... 2/424
5,185,889 A * 2/1993 Kamata ..... 2/424
5,333,329 A * 8/1994 Hong ..... 2/424
5,368,427 A * 11/1994 Pfaffinger ..... 411/553
5,444,875 A * 8/1995 Taniuchi ..... 2/424
5,448,780 A * 9/1995 Gath ..... 2/424
5,680,656 A * 10/1997 Gath ..... 2/424
6,438,763 B2 * 8/2002 Guay et al. ..... 2/424
6,732,380 B1 * 5/2004 Lee ..... 2/424
6,826,783 B1 * 12/2004 Grove et al. ..... 2/424
6,948,813 B2 * 9/2005 Parks ..... 351/158
38,991 A1 * 1/2006 Halsnes et al. ..... 2/424
7,124,449 B2 * 10/2006 Sutter et al. ..... 2/418
2006/0117467 A1 * 6/2006 Choi et al. ..... 2/424
2007/0050896 A1 * 3/2007 Stevens ..... 2/427
2007/0124851 A1 * 6/2007 Pyo ..... 2/424
2008/0072364 A1 * 3/2008 Schimpf ..... 2/424
2008/0141443 A1 * 6/2008 Arai ..... 2/424
2009/0113607 A1 * 5/2009 Lian ..... 2/427

* cited by examiner

*Primary Examiner* — Alissa L Hoey
*Assistant Examiner* — Andrew W Collins
(74) *Attorney, Agent, or Firm* — Pearne & Gordon LLP

(57) ABSTRACT

Provided is a helmet including a half helmet-shaped helmet main body including a main body through hole at each side thereof; a shield that is rotated vertically at a front side of the helmet main body and inserted into the helmet main body and has a through hole at each end thereof so as to be detachably connected to the helmet main body; and a holder having a penetrating connection shaft at its lower surface, the penetrating connection shaft capable of being inserted through the main body through hole and the shield through hole from the outside of the helmet main body and connecting the shield to the helmet main body so as to be rotated vertically.

8 Claims, 11 Drawing Sheets

HELMET HAVING ROTATABLE SHIELD

FIELD OF THE INVENTION

The present disclosure relates to a helmet including a shield which can open and close an opening formed at a front side of the helmet, more particularly, a helmet including a detachably attached holder which is inserted through both sides of a helmet main body and by which the shield is clamped such that the shield can be rotated vertically.

BACKGROUND OF THE INVENTION

A rider is necessarily required to wear a helmet when riding a two-wheeled vehicle such as a motorcycle, and the helmet generally has a front opening at a front side of its main body in order to allow a wearer to obtain a front view. Further, the helmet generally has a selectively openable/closable shield to prevent wind or dust from being introduced through the front opening while the vehicle moves forwards.

However, conventionally, a shield which can be opened and closed vertically at a front opening of a helmet is exposed to the outside of the helmet, so that the exposed shield can be at risk of damage from an external shock.

Further, a helmet main body includes a predetermined holder to connect the shield to the helmet main body so that the shield can be moved vertically, and in order to do so, the helmet main body further includes through holes for allowing the shield to be connected at its both sides. Generally, the holder is connected to the helmet main body with the shield therebetween through the through holes formed at both sides of the helmet main body. A connecting member such as a rivet can be used as the holder. The holder is fixedly attached to the helmet main body in a manufacturing process of the helmet, so that it is impossible or difficult for a helmet wearer to attach or detach the holder to/from the helmet main body at a time of use.

An upper surface of the holder, which is connected to the helmet main body and exposed to the outside of the helmet, is usually formed into a simple shape such as a non-specific rivet shape. Therefore, when exposed, the holder is not remarkable in appearance and its exposed appearance can not be utilized in view of design.

Further, the helmet has a hermetically sealed structure where little air can get in or get out, which makes the helmet wearer easily feel stuffy inside the helmet. In order to solve this problem, there has been proposed a half helmet instead of a full-face helmet.

BRIEF SUMMARY OF THE INVENTION

The present disclosure provides a helmet including a shield which is inserted into a helmet main body and the holder which assists a helmet wearer to attach and detach the shield to/from the helmet main body with ease.

Further, the present disclosure provides a helmet including a holder which assists a shield to be detachably connected to a helmet main body and can be utilized as an advertising or marketing tool in various ways.

In view of the foregoing, in accordance with an aspect of the present disclosure, there is provided a helmet including: a half helmet-shaped helmet main body including a main body through hole at each side thereof; a shield that is rotated vertically at a front side of the helmet main body and inserted into the helmet main body and has a through hole at each end thereof so as to be detachably connected to the helmet main body; and a holder having a penetrating connection shaft at its lower surface, the penetrating connection shaft capable of being inserted through the main body through hole and the shield through hole from the outside of the helmet main body and connecting the shield to the helmet main body so as to be rotated vertically.

Further, the helmet main body may include a fixing plate capable of fixing the penetrating connection shaft to the inside surface of the helmet main body so as to prevent the holder and the shield from being freely detached, and guiding a vertical movement of the shield.

Furthermore, the fixing plate may include a penetrating connection hole which penetrates inside and outside surfaces of the fixing plate and comes into contact with the penetrating connection shaft at the inside surface of the fixing plate. A connecting member inserted through the penetrating connection hole from the outside of the fixing plate may be connected to a hollow groove formed at an end portion of the penetrating connection shaft so as to prevent the holder and the shield from being freely detached.

Further, the fixing plate further may include a fixing plate connection hole which penetrates the inside and outside surfaces of the fixing plate and is formed at one or more places in the end portion. A connecting member inserted through the fixing plate connection hole from the outside of the fixing plate may be connected to an inside surface of the helmet main body so as to attach and fix the fixing plate to the inside surface of the helmet main body.

Furthermore, the fixing plate may include one or more moving engagement protrusions at the inside surface thereof. According to a vertical movement of the shield, the moving engagement protrusion may be disconnected from a moving hole, connected to the moving engagement protrusion, among a multiple number of moving holes formed at both end portions of the shield and then may be connected to another moving hole so as to prevent a pre-adjusted opening/closing position of the shield from being changed.

Further, a lower surface of the holder may include a holder connection shaft having a connection rib protruded from an end portion thereof. The holder connection shaft may be inserted through a main body connection hole formed at each side of the helmet main body, and the connection rib may be positioned on a connection receiving portion of the helmet main body at the time of a locking rotation of the holder. Therefore, the holder can be connected to the helmet main body.

Furthermore, the helmet main body may include a fixing support which may be formed at a top inner surface of the helmet main body and allow the shield to be inserted into the helmet main body to a predetermined depth while the shield is rotated upwards.

In accordance with another aspect of the present disclosure, there is provided a helmet provided with a holder which detachably connects a shield moving vertically at a front side of a helmet main body to the helmet main body, the helmet including: the holder of which a lower surface includes a penetrating connection shaft inserted through a main body through hole and connecting the shield to the helmet main body, and a holder connection shaft having a connection rib at its end portion, the connection rib being inserted through a main body connection hole and thereby connecting and disconnecting the holder with the helmet main body. An upper surface of the holder may be in the form of any one of a popular character, a logo or a figure.

Furthermore, the helmet main body may include a penetrating connection hole through which the penetrating connection shaft of holder is inserted; a main body through hole through which the holder connection shaft of the holder is inserted; and a fixing plate that is attached and fixed to an inside surface of the helmet main body by a connecting member inserted through a fixing plate connection hole. The shield may connected to the penetrating connection shaft of the holder at the inside surface of the fixing plate so as to be guided and rotated vertically.

Further, at the time of a locking rotation of the holder, the connection rib is rotated to be locked, so that the holder connection shaft allows the holder to be connected to the helmet main body, and at the time of an unlocking rotation, the connection rib is rotated to be unlocked, so that the holder connection shaft allows the holder to be disconnected from the helmet main body. Therefore, the shield may be attached and detached to/from the helmet main body.

In accordance with one of methods of the present disclosure, the helmet wearer can easily connect and disconnect the shield with the helmet main body by means of a locking rotation and an unlocking rotation of the holder.

Further, the shield is inserted into the helmet main body, so that the shield fragile to an external shock can be protected and its life can be lengthened. Furthermore, the helmet main body is in the form of a half helmet, which makes a feeling better with the helmet on.

Moreover, the upper surface of the holder, which is connected to the helmet main body and exposed to the outside of the helmet, can be in the form of, e.g., a corporate logo, a pattern, a figure, a popular character, or the like. Therefore, the holder can be utilized as an advertising or marketing tool, and the holder itself can be merchandized.

BRIEF DESCRIPTION OF THE DRAWINGS

The disclosure may best be understood by reference to the following description taken in conjunction with the following figures:

FIG. 4A illustrates a lower surface of the holder, FIG. 4C illustrates how the holder is connected to a helmet main body;

FIG. 5A illustrates an inside surface of the fixing plate, and FIG. 5B illustrates an outside surface of the fixing plate; FIG. 6A illustrates how the holder, the helmet main body, the shield, and the fixing plate are connected to one another outside the helmet, and FIGS. 6B and 6C illustrate how the holder, the helmet main body, the shield, and the fixing plate are connected to one another inside the helmet.

DETAILED DESCRIPTION OF THE INVENTION

Figure 1:
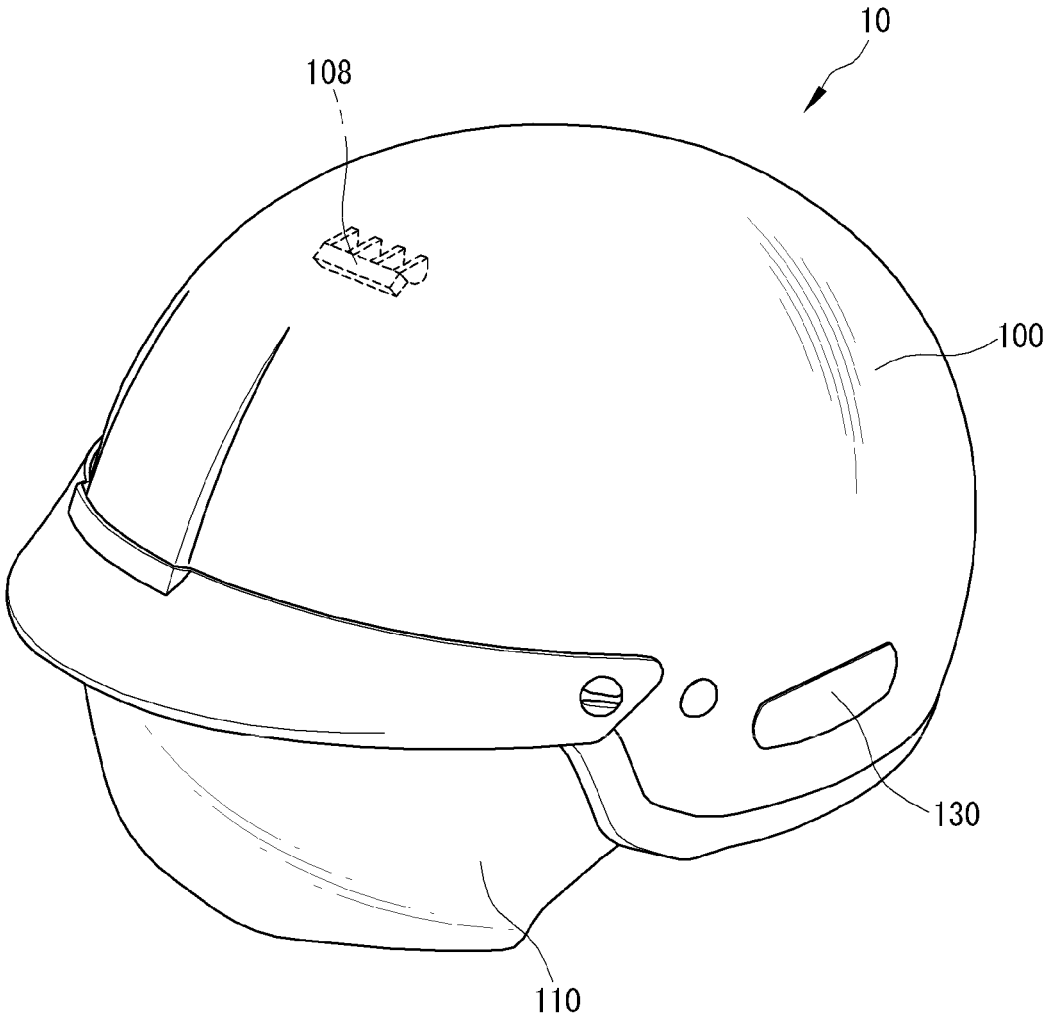
FIG. 1 is a perspective view of a helmet in accordance with an embodiment of the present invention.

Hereinafter, embodiments of the present invention will be described in detail with reference to the accompanying drawings so that the present invention may be readily implemented by those skilled in the art. However, it is to be noted that the present invention is not limited to the embodiments but can be realized in various other ways. In the drawings, parts irrelevant to the description are omitted for the simplicity of explanation, and like reference numerals denote like parts through the whole document.

Through the whole document, the term "connected to" or "coupled to" that is used to designate a connection or coupling of one element to another element includes both a case that an element is "directly connected or coupled to" another element and a case that an element is "electronically connected or coupled to" another element via still another element. Further, the term "comprises or includes" and/or "comprising or including" used in the document means that one or more other components, steps, operation and/or existence or addition of elements are not excluded in addition to the described components, steps, operation and/or elements.

Hereinafter, there will be explained a helmet in accordance with an embodiment of the present invention with reference to FIGS. 1 to 6.

FIG. 1 is a perspective view of a helmet 10 in accordance with an embodiment of the present invention showing that a shield 110 is positioned at the front side of a helmet main body 100 and part of the shield 110 is inserted into the helmet main body 100.

Hereinafter, the helmet 10 in accordance with an embodiment of the present invention will be explained with reference to FIG. 1.

As illustrated in FIG. 1, the helmet 10 includes the helmet main body 100, the shield 110, and a holder 130. Although not illustrated in FIG. 1, a fixing plate 150 illustrated in FIGS. 5A and 5B may be further included in the helmet main body.

The helmet 10 is used by a driver of a racing car or a rider of a motorcycle to protect his/her head from a possible accident, and thus the helmet 10 has a helmet main body 100 where a wearer's head can be accommodated.

The helmet main body 100 constitutes a main body of the helmet 10, and its inside where the wearer's head is accommodated is made of an elastic material such as urethane. Generally, the helmet main body 100 is in the form of a full-face helmet which can fitly enclose the wearer's head. However, a hermetically sealed structure (where little air can get in or get out) of the full-face helmet makes the wearer feel stuffy inside the helmet. Accordingly, for the sake of improvement in a feeling with the helmet on and fashion, the helmet main body 100 may be in the form of a half helmet made up of only an upper half of the full-face helmet. If the helmet main body 100 is in the form of the half helmet, a lower portion of the helmet 10 is open to the outside, so that the problem caused by the hermetically sealed structure can be solved. Further, the helmet 10 including the helmet main body 100 in the form of the half helmet allows the wearer to easily put on or take off and gets the wearer's hair disheveled much less. The helmet main body 100 can be made of various materials, and designs for the sake of beauty of its appearance and protection of the wearer's head. The helmet main body 100 will be explained in detail with reference to FIG. 2.

The shield 110 is a kind of a transparent window which can be selectively opened and closed vertically, so that the wearer's view does not interfered with wind, rain, or snow introduced through the front opening while travelling forwards. When moving upwards, part or whole of the shield 110 is inserted into the helmet main body 100, whereas when moving downwards, the shield 110 comes out and is positioned at the front side of the helmet main body 100. That is, part or whole of the shield 110 is exposed to the outside of the helmet main body 100 by moving downwards, and assists the wearer to obtain a view without interruption of wind or the like. The shield 110 will be explained in detail with reference to FIG. 3.

The holder 130 is a connecting member to connect the shield 110 to the helmet main body 100 in a way of being rivet-coupled, bolt-screw coupled, or fitted into each other so that the shield 110 can be rotated vertically. If the holder 130 is coupled to the helmet main body 100 by such a rivet connection, the shield 110 can be connected to the helmet main body 100, so that there may be no additional need to use a fixing member such as a fixing plate 150 to be described below. Further, the holder 130 is detachably provided, so that it is possible to rotatably connect the shield 110 to the helmet main body 100 by means of a locking rotation (see FIG. 4C) and also disconnect the shield 110 from the helmet main body 100 by means of an unlocking rotation (see FIG. 4C). The holder 130 and the helmet main body 100 can be made of the same material and color and also may be made of different materials or colors from each other for the sake of the wearer's personality, design or taste. The holder 130 will be explained in detail with reference to FIGS. 4A to 4C.

The fixing plate 150 is a fixing member to be attached to the inside surface of the helmet main body 100. The fixing plate 150 is a fixing member capable of guiding the shield 110 to move vertically and preventing the shield 110 and the holder 130 from being freely detached by being coupled to a part of the holder 130 so that the holder 130 can be rotated to be locked or rotated to be unlocked (see FIGS. 5A and 5B). The part of the holder 130 to be coupled to the fixing plate 150 can be a penetrating connection shaft 131 to be described later. The fixing plate 150 can be made of the same material as the helmet main body 100 and can be also made of an elastic material having elasticity suitable to easily attach and detach the shield 110. If the fixing plate 150 is made of an elastic material, part of the fixing plate 150 attached to the helmet main body 100 is disconnected therefrom and then the fixing plate 150 is bent to form a space where the shield 110 can get in and get out, so that the shield 110 can be disconnected from the helmet main body 100 with more ease. However, even if the fixing plate 150 is made of the elastic material, the material should have enough strength to provide a function of preventing a free opening/closing of the shield 110, which will be described later. A configuration and function of the fixing plate 150 will be explained in detail with reference to FIG. 5.

Hereinafter, the helmet main body 100 will be explained with reference to FIG. 2.

Figure 2:
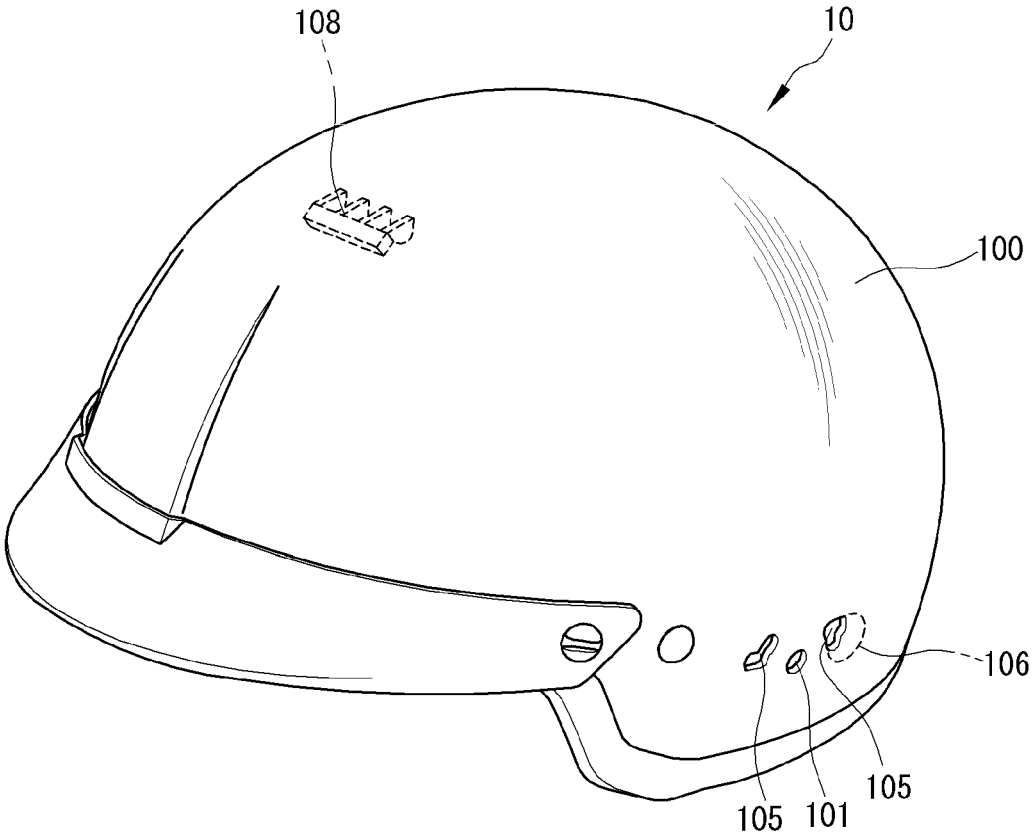
FIG. 2 is a perspective view of a helmet main body.

FIG. 2 is a perspective view of the helmet main body 100 in the form of a half helmet.

As illustrated in FIG. 2, the helmet main body 100 in the form of the half helmet includes a main body through hole 101 at each side and may further include a main body connection hole 105, a connection receiving portion 106, and a fixing support 108.

The main body through hole 101 is a through hole through which the following penetrating connection shaft 131 formed at a lower surface of the holder 130 is inserted and passes. The main body through hole 101 is formed by penetrating the inside and outside surfaces of the helmet main body 100 at each side of the helmet main body 100. Further, the main body through hole 101 should be formed to have a larger cross-section than that of the penetrating connection shaft 131 so that the holder 130 connected by the penetrating connection shaft 131 can be rotated to be locked or rotated to be unlocked. As long as the holder 130 can be rotated in a state that the penetrating connection shaft 131 is inserted into the inside of the helmet main body 100, the main body through hole 101 may be formed to have a cross-section in various shapes such as a circle, a tetragon, a pentagon, a hexagon or the like. Furthermore, the main body through hole 101 at left and right sides of the helmet main body 100 may be formed to have a cross-section in a different shape from each other.

As illustrated in FIG. 2, the main body connection hole 105 is a kind of a through hole through which a holder connection shaft 135 is inserted and passes, and each main body connection hole 105 may be formed on both sides of the main body through hole 101 formed at each side of the helmet main body 100. The main body connection hole 105 illustrated in FIG. 2 is an example, and one or more main body connection holes 105 may be formed around the main body through hole 101. The main body connection hole 105 is formed to have a cross-section suitable for connection with the holder connection shaft 135 and have a larger through hole than a cross-section of the holder connection shaft 135 so as to receive the holder connection shaft 135 to be inserted thereinto. Here, the main body connection hole 105 should be formed into a through hole such that a connection rib 136 protruded from an end portion of the holder connection shaft 135 rotated by means of a locking rotation of the holder 130 can be fastened (see FIGS. 4A to 4C). In other words, the main body connection hole 105 is formed such that when the holder 130 is inserted into the main body connection hole 105 or rotated to be unlocked, the connection rib 136 can freely get in and get out of the helmet main body 100. On the contrary, the main body connection hole 105 is formed such that when the holder 130 is rotated to be locked, the connection rib 136 can not get out of the helmet main body 100 freely. In order to provide this function, the main body connection hole 105 should be formed such that the holder connection shaft 135, while kept inserted into the helmet main body 100, can be rotated inside the helmet main body 100 on a central axis of the penetrating connection shaft 131 at the time of a locking rotation or an unlocking rotation of the holder 130.

In other words, the main body connection hole 105 is a through hole provided to have a cross-section as large as the holder connection shaft 135 and the connection rib 136 can be inserted as well as formed such that the holder connection shaft 135 can not be freely disconnected from the helmet main body 100 when the holder 130 is rotated to be locked. The connection receiving portion 106 may be formed around the main body connection hole 105 at an inner surface of the helmet main body 100.

The connection receiving portion 106 is a part of the inner surface of the helmet main body 100 where the connection rib 136 to be described later is placed at the time of a locking rotation of the holder 130 (see FIGS. 6B and 6C). The connection receiving portion 106 is formed around the main body connection hole 105 at the inner surface of the helmet main body 100 such that the holder 130 can not get out, i.e., can not be disconnected from the helmet main body 100. To be specific, it is a space where the connection rib 136 protruded from the end portion of the holder connection shaft 135 is placed at the time of a locking rotation of the holder 130. The connection receiving portion 106 is continuously connected with the main body connection hole 105 and formed to be lower than any other inner surface of the helmet main body 100. However, it is not necessary for the connection receiving portion 106 to be formed differently from any other inner surface of the helmet main body 100 as long as it is formed at the inside surface of the helmet main body 100 capable of receiving the connection rib 136 to prevent the holder 130 from being freely disconnected at the time of a locking rotation of the holder 130. That is, a portion of the inner surface of the helmet main body 100 where the connection rib 136 is received at the time of a locking rotation of the holder 130 is formed as the connection receiving portion 106. When the connection rib 136 is received at the connection receiving portion 106, the holder 130 is not freely disconnected from the helmet main body 100 by the received connection rib 136, and thus the shield 110 can not be also disconnected freely.

Further, inside the helmet main body 100, the fixing support 108 may be installed.

The fixing support 108 is a support serving to prevent the shield 110 from being inserted into the helmet main body farther than predetermined when the shield 110 is moved upwards into the helmet main body 100. The fixing support 108 prevents the shield 110 from being inserted too far into the helmet main body 100, which keeps a predetermined portion of the shield 110 exposed to the outside of the helmet main body 100. Accordingly, the helmet wearer can move the shield 110 downwards by pulling down a part of the exposed shield 110. In order to do so, the fixing support 108 is desirably located at a front top (inner) portion of the helmet 10. Further, the fixing support 108 may be partially or wholly made of an elastic material in order to prevent a shock from a possible collision between the shield 110 and the fixing support 108 when the shield 110 is inserted and prevent a shortening of the life of the shield 110 due to such a collision.

Hereinafter, the shield 110 will be explained with reference to FIG. 3.

Figure 3:
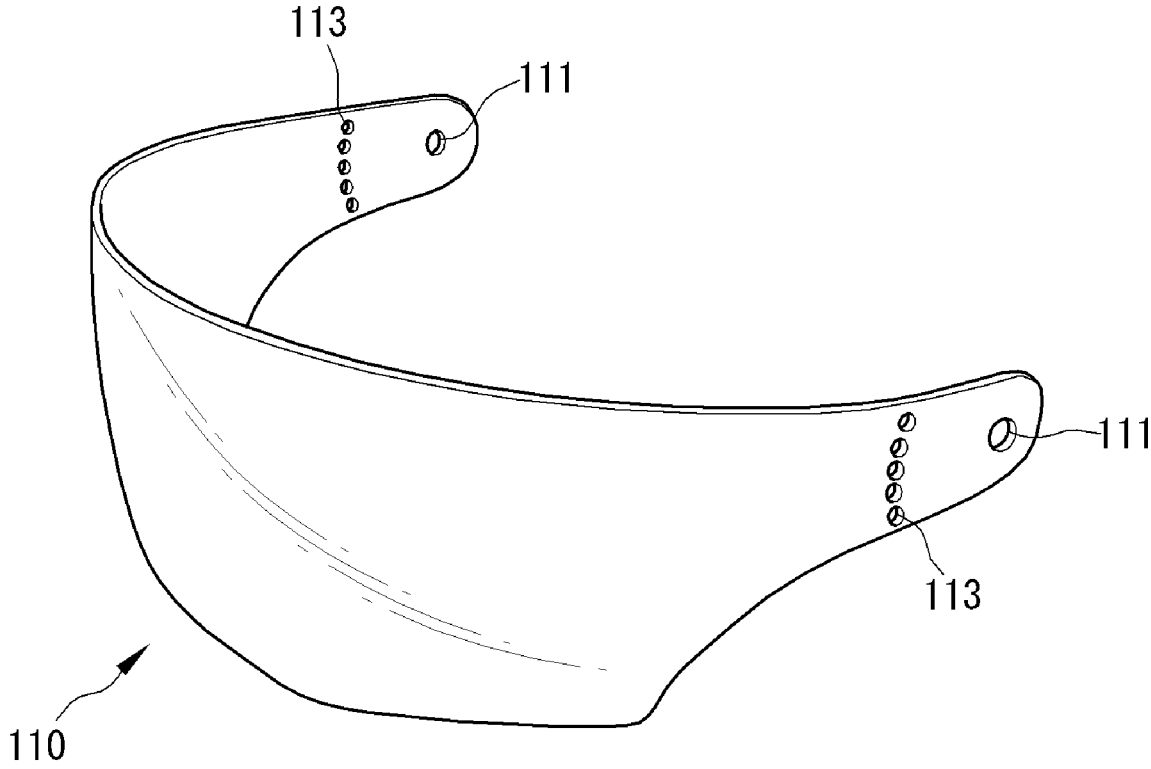
FIG. 3 is a perspective view of a shield.

FIG. 3 is a perspective view of the shield 110.

As illustrated in FIG. 3, the shield 110 may include a shield through hole 111 and moving holes 113 at each side thereof.

The shield through hole 111 is a hole formed at each side of the shield 110 so that the penetrating connection shaft 131 of the holder 130 penetrates through this hole 111. The shield 110 is supported by the penetrating connection shaft 131 inserted through the shield through hole 111 within the helmet main body 100 and connected with the helmet main body 100 so as to be moved vertically. Further, when the holder 130 is disconnected from the helmet main body 100, the penetrating connection shaft 131 is released from the shield through hole 111, so that the shield 110 can be also easily disconnected from the helmet main body 100. By using the holder 130 connected and disconnected with the helmet main body 100, the shield 110 can be easily connected and disconnected with the helmet main body 100. Therefore, the helmet wearer may select and use one of the shields 110 in various colors, shapes and functions according to his/her need or taste. Accordingly, the shield 110 including a standardized shield through hole 111 at its both sides can be merchandized by itself. In order to do so, the shield through hole 111 may be formed to have a circular cross-section having a larger diameter than a diameter of a cross-section of the penetrating connection shaft 131 to be inserted through the shield at each side thereof. However, as long as the shield 110 can be moved vertically in connection with the penetrating connection shaft 131, the shield through hole 111 may be formed to have a cross-section in various shapes such as a circle, a tetragon, a pentagon or the like. Further, in order to correspond to various sizes and shapes of the holder 130, the shield through holes 111 formed at both sides of the shield 110 may be formed into a different shape from each other.

The moving holes 113 are through holes additionally formed at both sides of the shield 110. As illustrated in FIG. 3, a multiple number of moving holes 113 are formed at each side of the shield 110 and arranged in a circular arc shape so as to be engaged with moving engagement protrusions 153 of the fixing plate 150 to be described later (see FIG. 5A). Therefore, the moving holes 113 are fitly engaged to the moving engagement protrusions 153, so that it is possible to prevent the shield 110 from being moved vertically regardless of the wearer's intention. Further, at the time of a vertical movement of the shield 110, it is possible to prevent the shield 110 from being freely moved from a pre-adjusted opening/closing position when any one of the moving holes 113 engaged with the moving engagement protrusions 153 is disengaged and another moving hole 113 is engaged with the moving engagement protrusion 153.

However, the moving holes 113 arranged in a circular arc shape at the shield 110 as shown in FIG. 3 are provided as an example of the present invention. The moving holes 113 can be provided in any manner suitable to maintain an opening/closing position pre-adjusted according to the vertical movement of the shield 110 to correspond to a shape, a distance, and a pattern of the moving engagement protrusions 153.

There will be explained the holder 130 and an insertion connection between the holder 130 and the helmet main body 100 with reference to FIGS. 4A to 4C.

Figure 4A:
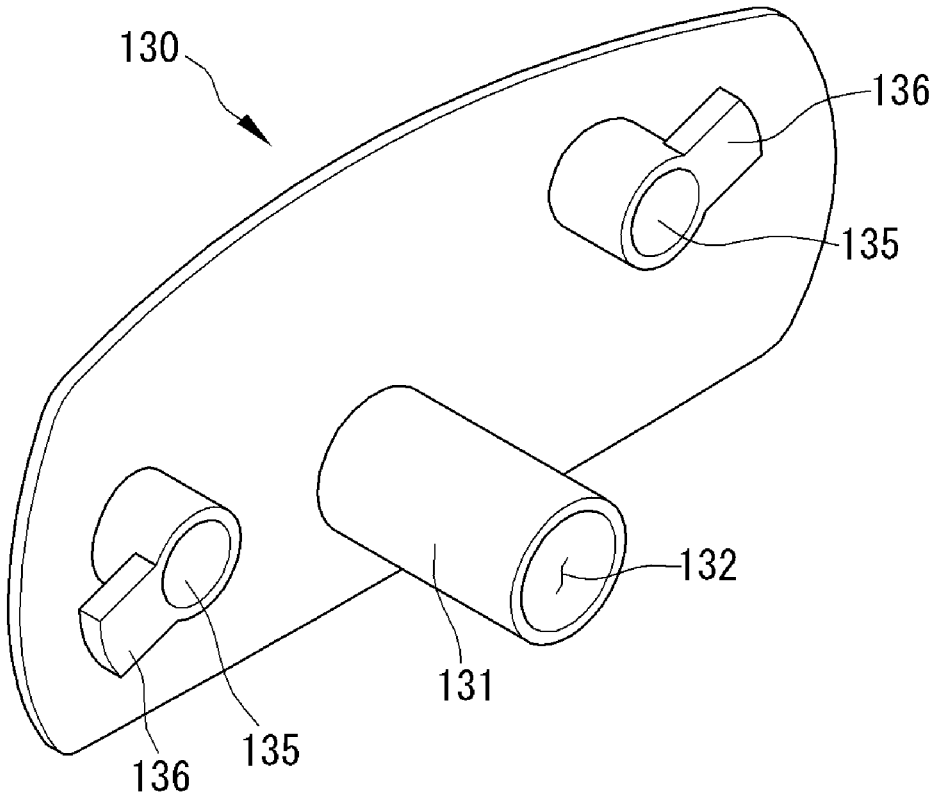
FIGS. 4A and 4C provide perspective views showing an embodiment of a holder applicable to the present invention, and to be specific.

FIG. 4*a* is a view showing a lower surface of the holder 130.

The lower surface of the holder 130 may include the penetrating connection shaft 131 and the holder connection shaft 135 which are inserted through into the helmet main body 100.

The penetrating connection shaft 131 is a connection shaft which is inserted through the main body through hole 101 and the shield through hole 111 from the outside of the helmet main body 100 and connects the shield 110 to the helmet main body 100 so that the shield 110 can be moved vertically. In order to do so, the penetrating connection shaft 131 should be long enough to be inserted through into the helmet main body 100 and the shield through hole 111 of the shield 110 and connected to the inside surface of the helmet main body 100. At an end portion of the penetrating connection shaft 131, a hollow groove 132 capable of receiving a rivet or a bolt is formed to be firmly fixed to the helmet main body 100. Further, the penetrating connection shaft 131 can be directly connected to the helmet main body 100 by bending or welding the penetrating connection shaft 131 without an additional connecting member, or can be formed suitable to be fitted into the main body through hole 101 from the outside of the helmet main body 100. Furthermore, the penetrating connection shaft 131 can be fitted into a penetrating connection hole 151 of the fixing plate 150 so as to prevent the holder 130 from being freely detached from the helmet main body 100.

The penetrating connection shaft 131 is inserted through into the helmet main body 100 from the outside thereof and serves to support the shield 110 connected between the helmet main body 100 and the end portion inserted through into the helmet main body 100, so that it should have enough strength to do so. Further, the penetrating connection shaft 131 should have a cross-section smaller than the shield through hole 111 so that the shield 110 connected with the penetrating connection shaft 131 inserted through the shield through hole 111 can be moved vertically.

However, as illustrated in FIG. 4*a*, it is not necessary for the penetrating connection shaft 131 to have a circular cross-section. As long as the penetrating connection shaft 131 can be connected to the shield through hole 111 of the shield 110 and can rotatably support the shield 110, it can be provided with a cross-section in various shapes.

In addition to the penetrating connection shaft 131, the lower surface of the holder 130 may further include the holder connection shaft 135 that assists the holder 130 to be directly connected or disconnected with the helmet main body 100 with ease.

The holder connection shaft 135 is inserted through the main body connection hole 105 from the outside of the helmet main body 100 and serves as an additional shaft for connecting the holder 130 to the helmet main body 100. The holder connection shaft 135 is protruded around the penetrating connection shaft 131 at the lower surface of the holder 130 according to the number of the main body connection holes 106 formed at the side surface of the helmet main body 100. Therefore, if two main body connection holes 105 are formed at the side surface of the helmet main body 100, two holder connection shafts 135 separate from the penetrating connection shaft 131 are also formed at the lower surface of the holder 130.

The holder connection shaft 135 is useful in case the penetrating connection shaft 131 does not serve as a connection shaft that directly connects or disconnects the holder 130 with the helmet main body 100. That is, the penetrating connection shaft 131 serves as a connection shaft that prevents the shield 110 from being freely detached and as a central shaft at the time of a locking rotation or an unlocking rotation of the holder 130, whereas the holder connection shaft 135 serves as a connection shaft that assists the holder 130 to be connected or disconnected with the helmet main body 100. To be specific, since the connection rib 136 protruded from the end portion of the holder connection shaft 135 is placed on the connection receiving portion 106 by means of a locking rotation of the holder 130, the holder 130 is connected with the helmet main body 100 and thus can not be disconnected freely. With this configuration, the holder 130 can be disconnected from the helmet main body 100 with ease and also, it becomes easy to disconnect the shield 110 (see FIG. 4C and FIG. 6C).

The connection rib 136 is protruded from the end portion of the holder connection shaft 135 inserted through the main body connection hole 105 into the helmet main body 100. The connection rib 136 is positioned on the main connection hole 105 when the holder 130 is inserted through into the helmet main body 100 or the holder 130 is rotated to be unlocked. On the contrary, when the holder 130 is rotated to be locked, the connection rib 136 is rotated in the same direction as the holder 130 is rotated on a central axis of the penetrating connection shaft 131, so that the connection rib 136 is released from the main connection hole 105 and placed on the connection receiving portion 106. The connection receiving portion 106 is not a kind of a through hole open to the outside but a space formed at an inner surface of the helmet main body 100 and closed to the outside of the helmet main body 100, so that when the connection rib 136 is placed on the connection receiving portion 106, the holder 130 can be not disconnected from the helmet main body 100 freely (see FIG. 4C and FIG. 6C). To be more specific, if the holder connection shaft 135 inserted through the main body connection hole 105 is rotated to be unlocked, the connection rib 135 protruded from the end portion of the holder connection shaft 135 is moved onto the connection receiving portion 106. Accordingly, the holder 130 is inserted through into the helmet main body 100 or the holder 130 is rotated to be unlocked, the connection rib 136 is exposed to the main body connection hole 105 and thus the holder 130 can be disconnected from the helmet main body 100. When the holder 130 is rotated to be locked, the connection rib 136 is placed on the connection receiving portion 106, so that the connection rib 136 is not exposed to the outside and thus the holder 130 can not be disconnected from the helmet main body 100 freely.

Figure 4B:
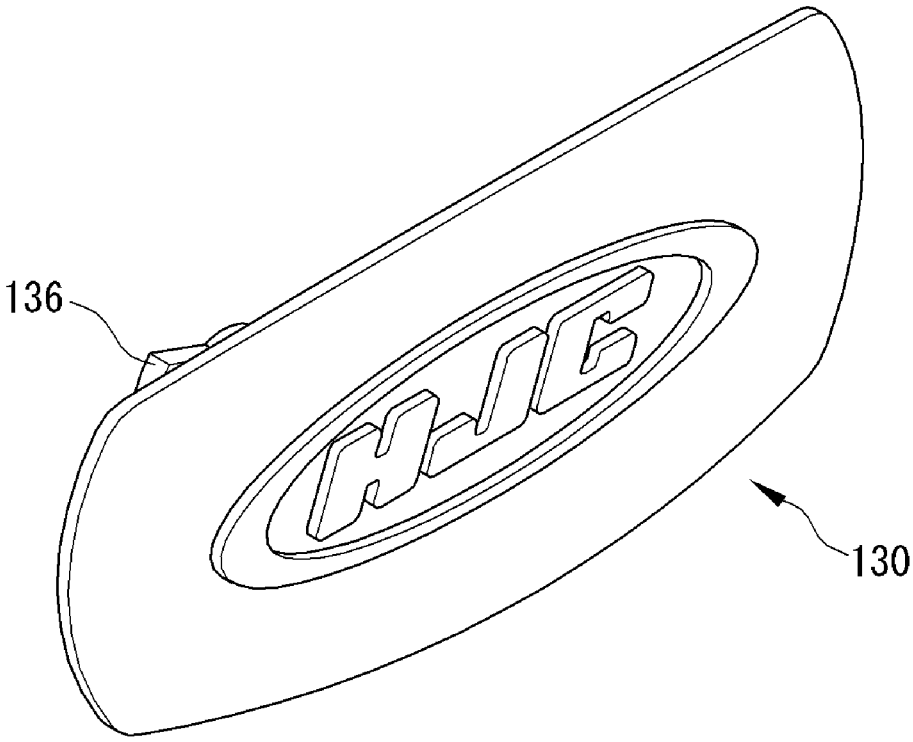
FIG. 4B illustrates an upper surface of the holder.
Figure 4C:
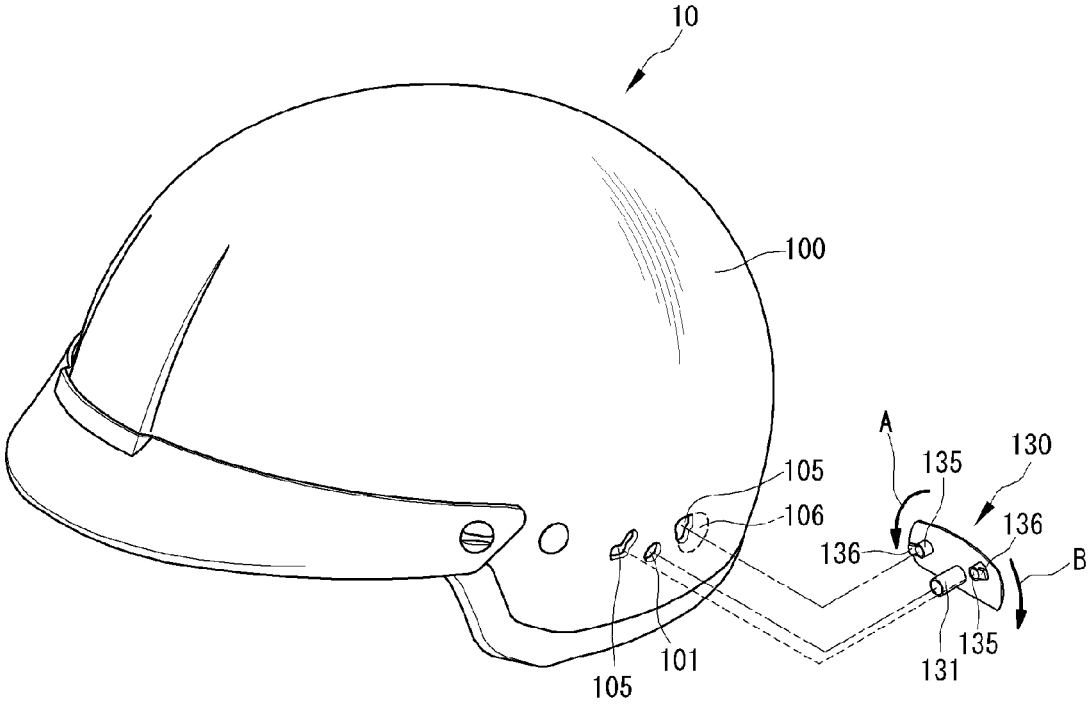

FIG. 4B or 4C illustrates an upper surface of the holder 130.

The upper surface of the holder 130 illustrated in FIG. 4B is a surface exposed to the outside of the helmet 10 after the holder 130 is inserted through into the helmet main body 100 as illustrated in FIG. 1. Since the upper surface of the holder 130 is exposed to the outside of the manufactured helmet 10, it can be utilized as an advertising or marketing tool in various ways. To be specific, the upper surface of the holder 130 can be in the form of, e.g., a corporate logo, a pattern, a figure, a popular character, or the like, whereby it can be utilized as an advertising or marketing tool. FIG. 4B provides an example of the upper surface of the holder 130 used as advertising or marketing tool. In FIG. 4B, "HJC" which is abbreviated from "HongJin HJC. Corp.", the name of the applicant of the present invention is marked on the upper surface, whereby the corporate itself or its product can be advertised.

As described above, the holder 130 can be attached and detached to/from the helmet main body 100, and when the penetrating connection shaft 131, the holder connection shaft 135 and the connection rib 136 installed at the lower surface are standardized in size, the helmet wearer may use the holder 130 of which the upper surface is in the various form of a logo, a pattern or the like. Further, the holder 130 itself can be merchandized as a separate product to be sold.

FIG. 4C is a perspective view showing how the holder 130 is connected to the helmet main body 100.

As illustrated in FIG. 4C, the penetrating connection shaft 131 of the holder 130 is inserted through the main body through hole 101 of the helmet main body 100 and the holder connection shaft 135 is inserted through the main body connection hole 105. The main body connection hole 105 is formed into an elongated through hole capable of receiving the connection rib 136 additionally protruded from the end portion of the holder connection shaft 135, so that the holder 130 can be inserted through into the helmet main body 100 with ease.

An arrow A in FIG. 4C indicates a direction of a locking rotation of the holder 130, whereas an arrow B indicates a direction of an unlocking rotation of the holder 130. At the time of the locking rotation (arrow A), the holder 130 inserted into the helmet main body 100 is rotated on a central axis of the penetrating connection shaft 131 so as not to be freely disconnected. The holder connection shaft 135 installed at the lower surface of the holder 130 is rotated in the same direction as that of the locking rotation of the holder 130 and the connection rib 136 formed at the end portion of the holder connection shaft 135 is also rotated in the same direction as that of the locking rotation. The connection rib 136 is stayed inside the main body connection hole 105 when the holder 130 is inserted through into the helmet main body 100, so that the holder 130 can be get into the helmet main body 100 with ease as being inserted through thereinto. However, at the time of the locking rotation of the holder 130, the holder connection shaft 135 and the connection rib 136 are rotated along with the holder 130 rotated on a central axis of the penetrating connection shaft 131, and at the time of finishing the locking rotation, the connection rib 136 is released from the main body connection hole 105 of the helmet main body 100 and positioned on the connection receiving portion 106 formed continuously with the main body connection hole 105. If the connection rib 136 is positioned on the connection receiving portion 106, the connection rib 136 is not allowed to get out and thus it is possible to prevent the holder 130 from being freely disconnected from the helmet main body 100.

At the time of the unlocking rotation (arrow B), the holder 130 inserted into the helmet main body 100 and connected thereto by means of the locking rotation is rotated in a reverse direction of the locking rotation, i.e., to a position where the holder 130 can be disconnected from the helmet main body 100. By means of the unlocking rotation, the connection rib 136 is separate from the connection receiving portion 106 and rotated and moved to the main body connection hole 105, so that when the holder 130 is pulled out of the helmet main body 100, the holder 130 is disconnected and separate from the helmet main body 100. Further, at the time of the separation of the holder 130 from the helmet main body 100, the holder 130 is separate from the penetrating connection shaft 131 that connects the shield 110 through the shield through hole 111 such that the shield 110 can be vertically moved. Accordingly, the shield 110 can be disconnected and separate from the helmet main body 100. With this configuration, it is advantageous in that a damaged shield 110 can be easily replaced with a new one or the shield 110 can be replaced with a shield having a different shape of a front side. Since the holder 130 can be easily connected and disconnected with the helmet main body 100 by means of the locking rotation and the unlocking rotation, respectively, as long as a lower surface of the holder 130 is formed in the same size or shape, the holder 130 with an upper surface in various shapes can be employed according to the wearer's taste.

Hereinafter, the fixing plate 150 will be explained with reference to FIGS. 5A and 5B.

Figure 5A:
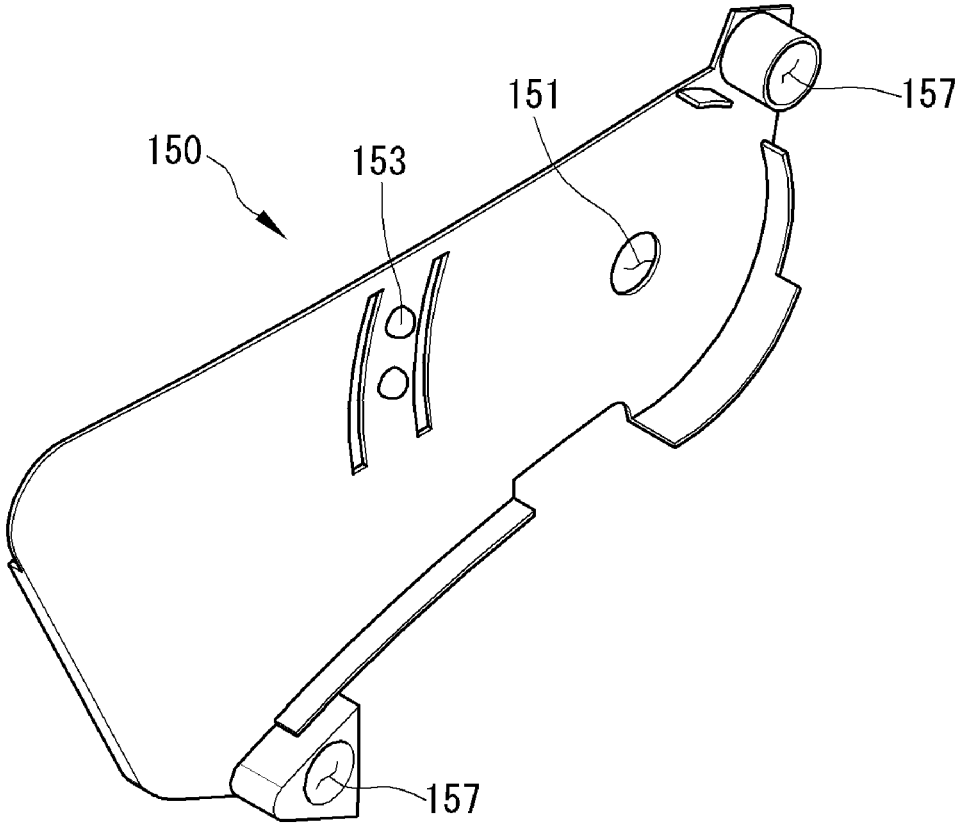
FIGS. 5A and 5B provide perspective views of an embodiment of a fixing plate applicable to the present invention, and to be specific.
Figure 5B:
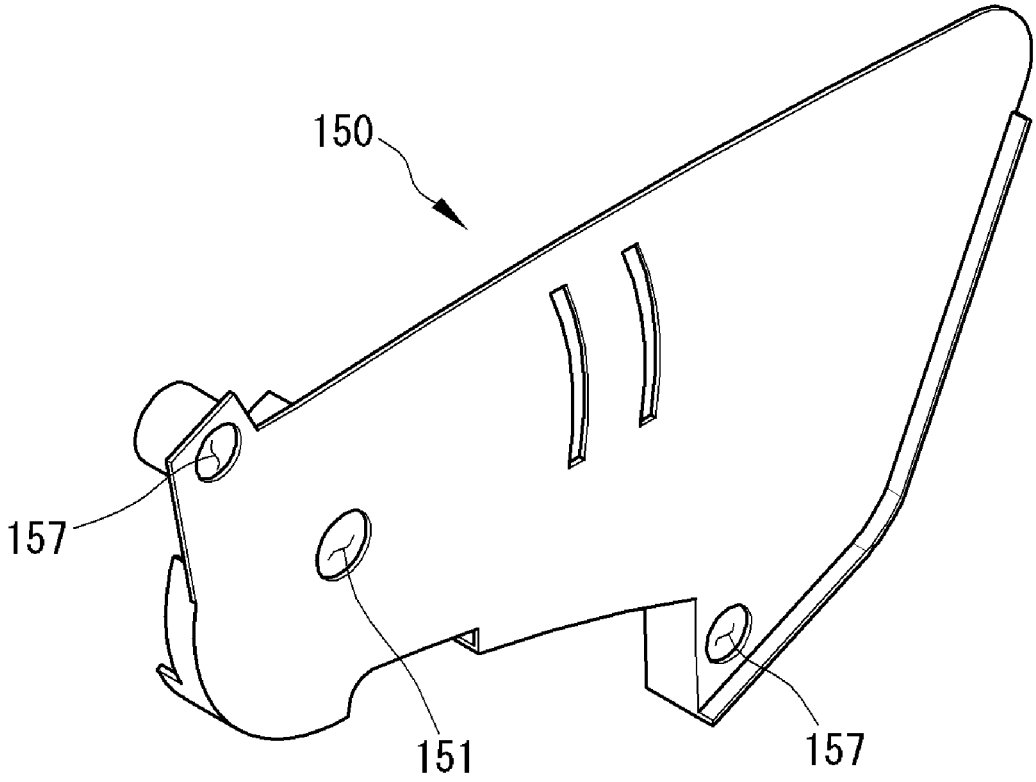

FIGS. 5A and 5B are perspective views of the fixing plate 150, and to be specific, FIG. 5A illustrates an inside surface of the fixing plate 150, and FIG. 5B illustrates an outside surface of the fixing plate 150.

The fixing plate 150 includes the penetrating connection hole 151 and the moving engagement protrusions 153 and may further include a fixing plate connection hole 157.

As illustrated in FIGS. 5A and 5B, the penetrating connection hole 151 comes into contact with the penetrating connection shaft 131 at the inside surface of the fixing plate 150 and the penetrating connection hole 151 is a through hole through which a connecting member can be inserted from the outside of the fixing plate 150 (see FIG. 6). The inside surface of the fixing plate 150 (see FIG. 5A) faces toward the helmet main body 100 and comes into contact with the penetrating connection shaft 131, whereby an inner space for receiving the shield 110 can be formed, whereas the outside surface of the fixing plate 150 (see FIG. 5B) is a part of the fixing plate 150 exposed to the outside of the helmet main body 100.

The connecting member may be a rivet, a bolt, a screw or the like and is configured to be inserted through the penetrating connection hole 151 from the outside surface of the fixing plate 150 and connected to the penetrating connection shaft 131 in contact with the penetrating connection hole 151 at the inside surface of the fixing plate 150. In order to do so, the hollow groove 132, having a thread formed therein, capable of receiving a rivet, a bolt, or a screw may be formed at the end portion of the penetrating connection shaft 131 inserted through into the helmet main body 100.

The moving engagement protrusions 153 are one or more protrusions protruded from the inner surface of the fixing plate 150 as illustrated in FIG. 5A. The moving engagement protrusions 153 are configured to be fitly engaged to the moving holes 113 formed at each side of the shield 110; and serve to prevent the shield 110 connected to the helmet main body 100 from being freely opened or closed; and guide the shield 110 when it is moved vertically. That is, the moving engagement protrusions 153 are fitly engaged to some of the multiple number of moving holes 113 formed at each side of the shield 110, so that it is possible to prevent the shield 110 from being freely moved upwards and downwards. If the helmet wearer pushes up or pulls down the shield 110 to move upwards or downwards, the shield 110 slides and a moving hole 113 which has been fitly engaged to the moving engagement protrusion 153 is disengaged and then another moving hole 113 is fitly engaged to the moving engagement protrusion 153 according to the upward or downward movement of the shield 110. At this time, the moving engagement protrusion 153 is fitly engaged to another moving hole 113 and allows the movement of the moving hole 113 to be controlled, whereby it is possible to prevent the shield 110 from being freely opened and closed regardless of the wearer's intention. With this configuration, it is possible to prevent an unintended movement of the shield 110 and also possible to guide the shield 110 to move to an intended opening/closing position.

Two or more moving engagement protrusions 153 may be formed so as to be fitly engaged to a multiple number of moving holes 113 stably. Alternatively, one moving engagement protrusion 153 may be formed.

The fixing plate connection hole 157 is formed into a through hole capable of attaching the fixing plate 150 to the helmet main body 100, and it can be formed at any one or more places on the end portion of the fixing plate 150 except a place where the upward and downward movement of the shield 110 may be interrupted. As illustrated in FIGS. 5A and 5B, the fixing plate connection hole 157 is formed by penetrating through the inside and outside surfaces of the fixing plate 150. By inserting the connecting member through into the fixing plate 150 from the outside thereof to be connected with the helmet main body 100, the fixing plate connection hole 157 allows the fixing plate 150 to be attached to the helmet main body 100.

The connecting member is inserted through the fixing plate connection hole 157 so as to attach the fixing plate 150 to the helmet main body 100. Generally, a rivet, a bolt, a screw or the like can be used as the connecting member.

Hereinafter, there will be explained how the holder 130, the helmet main body 100, the shield 110, and the fixing plate 150 are combined with reference to FIGS. 6A to 6C. However, the helmet main body 100, the shield 110, the holder 130, and the fixing plate 150 have been explained above, so that there will be described interconnection relationship therebetween.

Figure 6A:
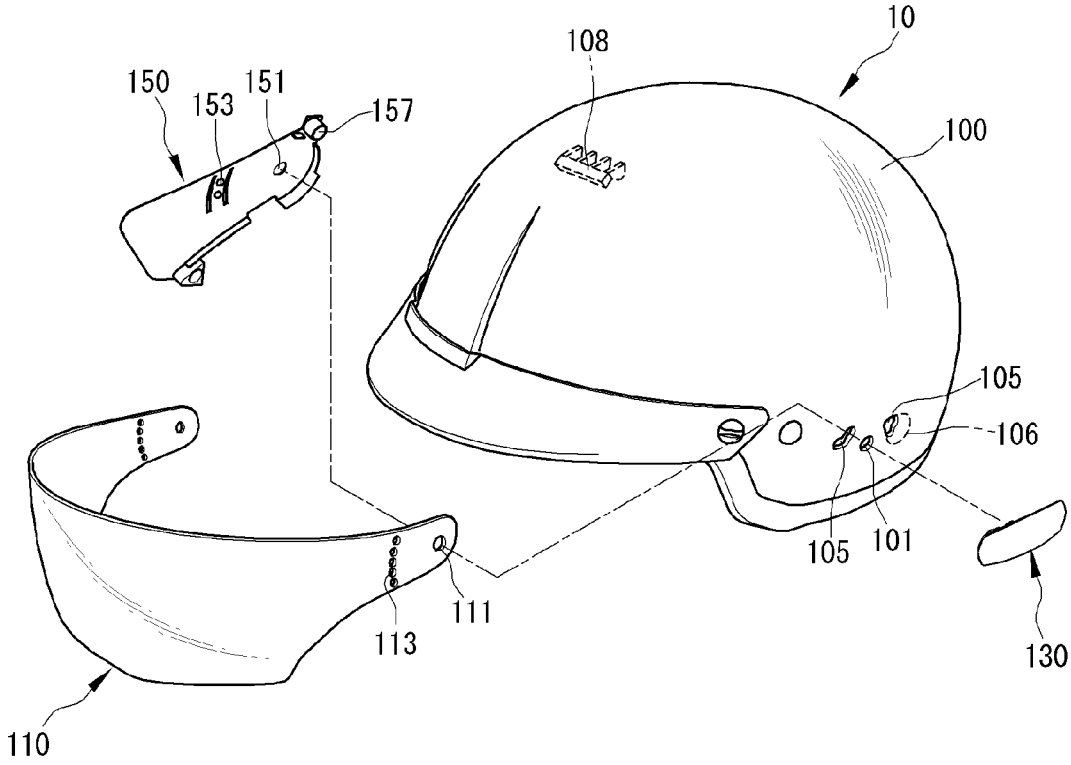
FIGS. 6A to 6C provide combined perspective views of a holder, a helmet main body, a shield, and a fixing plate, and to be specific.
Figure 6B:
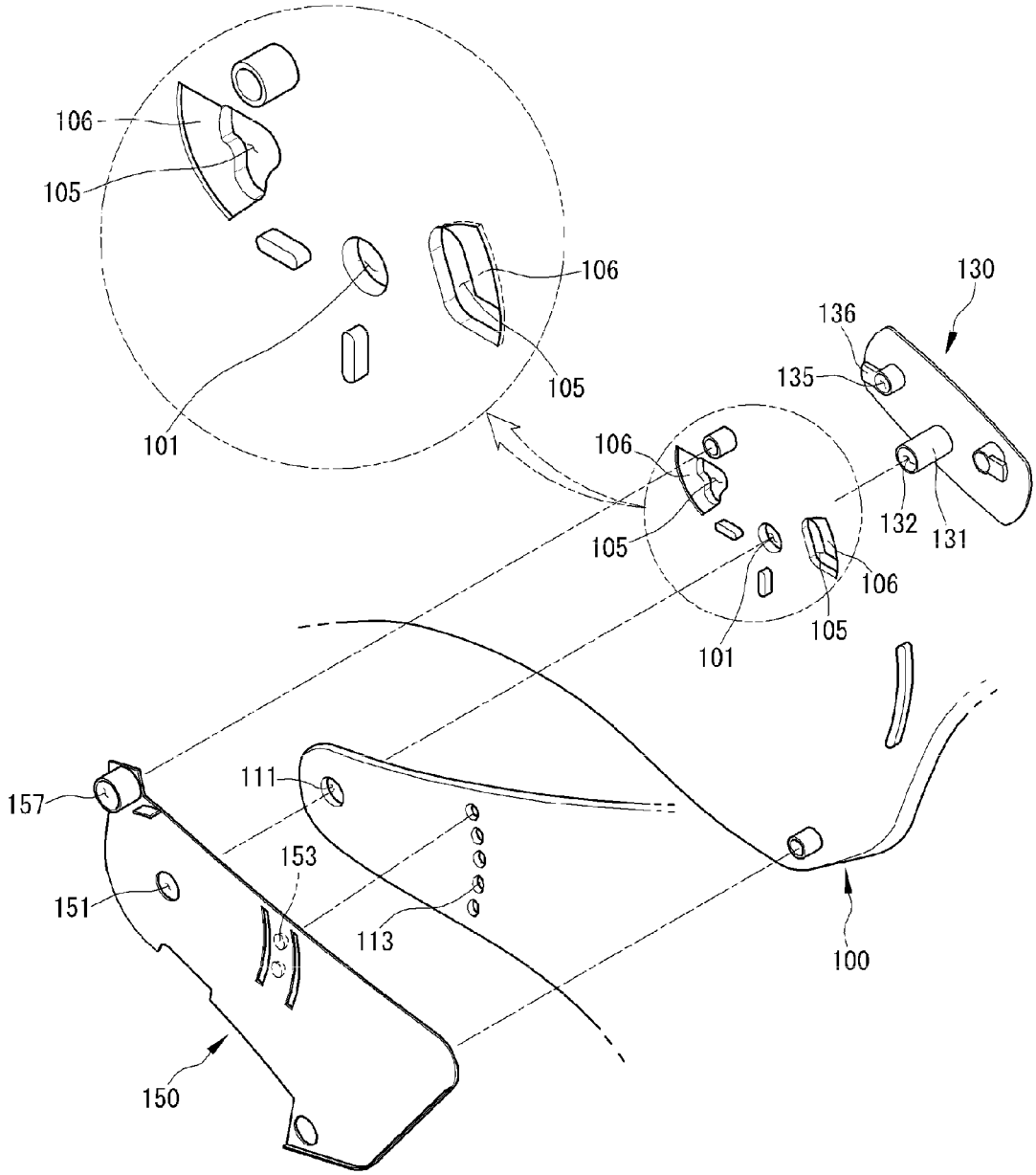
Figure 6C:
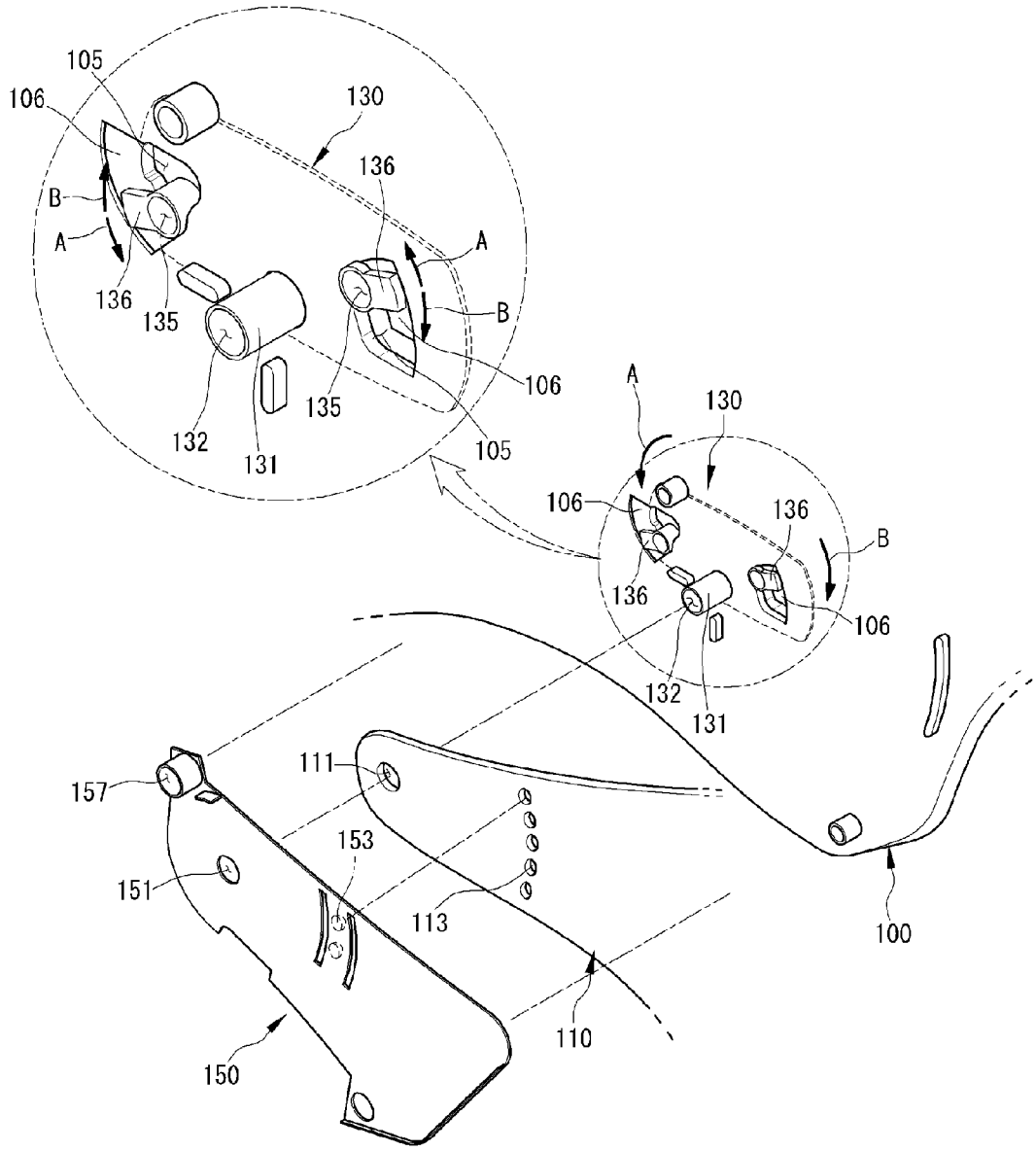

FIGS. 6A to 6C provide combined perspective views of the holder 130, the helmet main body 100, the shield 110, and the fixing plate 150, and to be specific, FIG. 6A illustrates how they are connected to one another outside the helmet 10, and FIGS. 6B and 6C illustrate how they are connected to one another inside the helmet 10.

As illustrated in FIGS. 6A to 6C, the holder 130 is inserted from the outside to the inside of the helmet main body 100 and the shield 110 and the fixing plate 150 are connected to the inside surface of the helmet main body 100.

As illustrated in FIG. 6A, after the holder 130 is inserted through into and connected to the helmet main body 100, the upper surface of the holder 130 is exposed to the outside of the helmet 10, whereas the lower surface thereof is inserted into the helmet main body 100. As described above, since the upper surface of the holder 130 is exposed to the outside, it can be utilized as an advertising or marketing tool, and since the lower surface of the holder 130 is standardized in size such that the holder 130 can be freely replaced, the holder 130 itself can be merchandized as a separate product.

As illustrated in FIG. 6B, the penetrating connection shaft 131 formed at the lower surface of the holder 130 can be inserted into the helmet main body 100 through the main body through hole 101 formed at each side of the helmet main body. The inserted penetrating connection shaft 131 is inserted through the shield through hole 111 of the shield 110 and then comes into contact with the penetrating connection hole 151 of the fixing plate 150. The connecting member, such as a screw or a bolt, inserted into the fixing plate 150 from the outside thereof is inserted through the penetrating connection hole 151 and connected to the penetrating connection shaft 131 of the holder 130. At this time, for the sake of easier connection, the hollow groove 132 may be formed at the end portion of the penetrating connection shaft 131 to be connected to the connecting member inserted through the penetrating connection hole 151. Through such a connection between the penetrating connection shaft 131 and the penetrating connection hole 151, the holder 130 is connected at the outside surface of the helmet main body 100 so that the holder 130 can be rotated to be locked or rotated to be unlocked (see FIG. 4C), and the shield 110 is connected to be rotated vertically within the helmet main body 100, with the shield 110 inserted into the helmet main body 100.

Further, the holder connection shaft 135 additionally installed on the lower surface of the holder 130 can be inserted into the helmet main body 100 through the main body connection hole 105 formed at each side of the helmet main body 100. Furthermore, the holder connections shaft 135 may further include the connection rib 136 protruded from its end portion in order to allow the holder 130 to be connected or disconnected with the helmet main body 100 after penetrating through the inside surface of the helmet main body 100. Accordingly, a cross-section of the main body connection hole 105 may be configured such that the holder connection shaft 135 having the connection rib 136 protruded therefrom can be inserted through the main body connection hole 105 as illustrated in FIG. 6B. That is, the main body connection hole 105 formed at each side of the helmet main body 100 has a cross-section capable of receiving the holder connection shaft 135 and the connection rib 136 to be inserted together with the holder connection shaft 135.

As illustrated in FIG. 6C, the holder 130 can be rotated to be locked or rotated to be unlocked while the penetrating connection shaft 131 and the holder connection shaft 135 are inserted into the helmet main body 100. The holder 130 is rotated to be locked or rotated to be unlocked on a central axis of the penetrating connection shaft 131, and at the time of the locking rotation (in a direction of the arrow A in FIG. 6C), the connection rib 136 formed at the end portion of the holder connection shaft 135 is released from the main body connection hole 105 and placed on the connection receiving portion 106 formed around the main body connection hole 105. The connection receiving portion 106 is a space closed to the outside of the helmet main body 100 unlike the main body connection hole 105, so that at the time of the locking rotation when the connection rib 136 is positioned on the connection receiving portion 106, the holder 130 is connected to the helmet main body 100 and can not be freely released or disconnected from the helmet main body 100. On the contrary, at the time of the unlocking rotation of the holder 130 (in a direction of the arrow B in FIG. 6C), i.e., at the time of a rotation of the locking-rotated holder 130 in a reverse direction (i.e., turning a state of FIG. 6C into a state of FIG. 6B), the connection rib 136 positioned on the connection receiving portion 106 is moved again to the main body connection hole 105. Since the main body connection hole 105 serves as an open through hole through which the connection rib 106 can get out, the holder 130 can be separated and disconnected from the helmet main body 100.

The shield 100 is connected by the penetrating connection shaft 131 inserted through the shield through hole 111 at the inside surface of the helmet main body so as to be moved vertically. Further, in order to prevent a position of the opened/closed shield 110 from being freely changed or to prevent a pre-adjusted opening/closing position of the shield 110 from being freely changed, a multiple number of moving holes 113 may be formed at each side of the shield 110 and the moving engagement protrusions 153 to be fitly engaged to the moving holes 113 may be formed at the inner surface of the fixing plate 150 corresponding to the moving holes 113. The moving engagement protrusions 153 are connected and fitly engaged to different moving holes 113 according to the upward/downward movement of the shield 110, so that the opening/closing position of the shield 110 can be maintained. It is possible to form one moving engagement protrusion 153 at the inner surface of the fixing plate 150 or it is also possible to form two or more moving engagement protrusions 153 for the sake of a stable and fit engagement.

Further, the fixing plate 150 may have the fixing plate connection hole 157 at one or two places in one end portion thereof as long as the upward/downward movement of the shield 110 is not interrupted. A connecting member is inserted through the fixing plate connection hole 157 from the outside of the fixing plate 150 and the connecting member is connected with the helmet main body 100. Accordingly, the fixing plate 150 is attached and fixed to the inside surface of the helmet main body 100.

The shield 110 is connected to the inside surface of the helmet main body 100 so that both sides of the shield 110 are covered and guided by the fixing plate 150 to move vertically.

The above description of the present disclosure is provided for the purpose of illustration, and it would be understood by those skilled in the art that various changes and modifications may be made without changing technical conception and essential features of the present disclosure. Thus, it is clear that the above-described embodiments are illustrative in all aspects and do not limit the present disclosure.

The scope of the present disclosure is defined by the following claims rather than by the detailed description of the embodiment. It shall be understood that all modifications and embodiments conceived from the meaning and scope of the claims and their equivalents are included in the scope of the present disclosure.

What is claimed is:

1. A helmet comprising:

a half helmet-shaped helmet main body including a main body through hole at each side thereof;

a shield that is rotated vertically at a front side of the helmet main body and inserted into the helmet main body and has a through hole at each end thereof so as to be detachably connected to the helmet main body; and a holder having a penetrating connection shaft at its lower surface, the penetrating connection shaft capable of being inserted through the main body through hole and the shield through hole from the outside of the helmet main body and connecting the shield to the helmet main body so as to be rotated vertically, wherein a lower surface of the holder includes:

a holder connection shaft having a connection rib protruded from an end portion thereof, wherein the holder connection shaft is inserted through a main body connection hole formed at each side of the helmet main body, and the connection rib is positioned on a connection receiving portion of the helmet main body at the time of a locking rotation of the holder, whereby the holder to connected to the helmet main body.

2. The helmet of claim 1, wherein the helmet main body includes:

a fixing plate capable of fixing the penetrating connection shaft to the inside surface of the helmet main body so as to prevent the holder and the shield from being freely detached, and guiding a vertical movement of the shield.

3. The helmet of claim 2, wherein the fixing plate includes:

a penetrating connection hole which penetrates inside and outside surfaces of the fixing plate and comes into contact with the penetrating connection shaft at the inside surface of the fixing plate, wherein a connecting member inserted through the penetrating connection hole from the outside of the fixing plate is connected to a hollow groove formed at an end portion of the penetrating connection shaft so as to prevent the holder and the shield from being freely detached.

4. The helmet of claim 3, wherein the fixing plate further includes:

a fixing plate connection hole which penetrates the inside and outside surfaces of the fixing plate and is formed at one or more places in the end portion, wherein a connecting member inserted through the fixing plate connection hole from the outside of the fixing plate is connected to an inside surface of the helmet main body so as to attach and fix the fixing plate to the inside surface of the helmet main body.

5. The helmet of claim 2, wherein the fixing plate includes:

one or more moving engagement protrusions at the inside surface thereof, wherein according to a vertical movement of the shield, the moving engagement protrusion is disconnected from a moving hole, connected to the moving engagement protrusion, among a multiple number of moving holes formed at both end portions of the shield and then is connected to another moving hole so as to prevent a pre-adjusted opening/closing position of the shield from being changed.

6. The helmet of claim 1, wherein the helmet main body includes:

a fixing support which is formed at a top inner surface of the helmet main body and allows the shield to be inserted into the helmet main body to a predetermined depth while the shield is rotated upwards.

7. A helmet provided with a holder which detachably connects a shield moving vertically at a front side of a helmet main body to the helmet main body, the helmet comprising:

the holder of which a lower surface includes a penetrating connection shaft inserted through a main body through hole and connecting the shield to the helmet main body, and a holder connection shaft having a connection rib at its end portion, the connection rib being inserted through a main body connection hole and thereby connecting and disconnecting the holder with the helmet main body, wherein at the time of a locking rotation of the holder, the connection rib is rotated to be locked, so that the holder connection shaft allows the holder to be connected to the helmet main body, at the time of an unlocking rotation, the connection rib is rotated to be unlocked, so that the holder connection shaft allows the holder to be disconnected from the helmet main body, whereby the shield is attached and detached to/from the helmet main body, and wherein an upper surface of the holder is in the form of any one of a popular character, a logo or a figure.

8. The helmet of claim 7, wherein the helmet main body includes:

a penetrating connection hole through which the penetrating connection shaft of holder is inserted;

a main body through hole through which the holder connection shaft of the holder is inserted; and a fixing plate that is attached and fixed to an inside surface of the helmet main body by a connecting member inserted through a fixing plate connection hole, wherein the shield is connected to the penetrating connection shaft of the holder at the inside surface of the fixing plate so as to be guided and rotated vertically.

* * * * *